US007824119B2

(12) United States Patent
Kershisnik et al.

(10) Patent No.: US 7,824,119 B2
(45) Date of Patent: Nov. 2, 2010

(54) TRANSACTION PRINTER

(75) Inventors: Kevin Kershisnik, Riverton, WY (US); Donna Norton, Riverton, WY (US); Eric Wolfe, Riverton, WY (US); David Selvig, Riverton, WY (US); Jon Walker, Pavillion, WY (US); Douglas Etsinger, Riverton, WY (US); Jeff Cooper, Riverton, WY (US)

(73) Assignee: Pertech Resources, Inc., Riverton, WY (US)

( * ) Notice: Subject to any disclaimer, the term of this patent is extended or adjusted under 35 U.S.C. 154(b) by 243 days.

(21) Appl. No.: 11/665,794

(22) PCT Filed: Nov. 10, 2005

(86) PCT No.: PCT/US2005/041124

§ 371 (c)(1),
(2), (4) Date: Apr. 19, 2007

(87) PCT Pub. No.: WO2006/062686

PCT Pub. Date: Jun. 15, 2006

(65) Prior Publication Data

US 2009/0058891 A1 Mar. 5, 2009

(51) Int. Cl.
*B41J 29/10* (2006.01)

(52) U.S. Cl. ..... 400/689; 400/247

(58) Field of Classification Search ..... 400/247, 400/689, 656, 124.11

See application file for complete search history.

(56) References Cited

U.S. PATENT DOCUMENTS

| | | | |
|---|---|---|---|
| 4,554,559 | A | 11/1985 | Heath |
| 4,726,699 | A | 2/1988 | Buschmann et al. |
| 4,778,291 | A | 10/1988 | Mitsuhashi |
| 4,803,500 | A | 2/1989 | Milbrandt |
| 4,872,027 | A | 10/1989 | Buskirk et al. |
| 5,049,904 | A | 9/1991 | Nakamura et al. |
| 5,372,512 | A | 12/1994 | Wilson et al. |
| 5,456,539 | A | 10/1995 | Wright et al. |
| 5,664,895 | A | 9/1997 | Asai et al. |
| 5,668,582 | A | 9/1997 | Manzone et al. |
| 5,815,192 | A | 9/1998 | Matsuo et al. |
| 6,203,131 | B1 | 3/2001 | Wiklof |
| 6,582,039 | B2 | 6/2003 | Johnson et al. |

FOREIGN PATENT DOCUMENTS

| | | | |
|---|---|---|---|
| DE | 3900989 | A1 | 7/1990 |
| JP | 06297785 | A | 10/1994 |
| JP | 03220734 | A | 8/2003 |
| JP | 0415474 | A | 1/2004 |
| WO | 9008040 | | 7/1990 |

OTHER PUBLICATIONS

International Search Report PCT/US05/41124.

*Primary Examiner*—Huan H Tran
(74) *Attorney, Agent, or Firm*—Tarolli, Sundheim, Covell & Tummino LLP

(57) ABSTRACT

A printer that can be configured either as a dot matrix/impact printer or an inkjet printer. A printer frame mounts a carriage mechanism for reciprocally moving a head carrier. An adapter secures a printhead to the carrier; the adapter being configured to accept a predetermined type of printhead. A compensator/feeder assembly is pivotally movable between a printing position and a printer open position at which a slot for receiving a form is defined. The compensator/feeder assembly mounts a printer bar which is positioned in a confronting relationship with the printhead when the assembly is in the printing position. A compensator drive arrangement is fixed to a base and effects movement in the feeder assembly.

26 Claims, 11 Drawing Sheets

TRANSACTION PRINTER

TECHNICAL FIELD

The present invention relates generally to methods and apparatus for printing receipts, forms, etc. and, in particular, to a relatively quiet transaction printer that may be configured either as a dot-matrix impact printer or as an inkjet printer.

BACKGROUND ART

Printers of the dot-matrix needle type with varying numbers of needles, are well known, as are printers of the inkjet type with varying numbers of nozzles. Printers that use either of these technologies interchangeably are also known, but, are different in the mix of printhead-technologies used, or, in the methods used to change-out the printheads, or in the methods used to adjust the gap between the printhead and the printed media.

DISCLOSURE OF INVENTION

The present invention provides a new and improved printing apparatus and method which interchangeably uses dot-matrix impact technology and inkjet printing technology. The invention also provides a compensator/feeder assembly for handling both roll print media and sheet media such as forms, checks, etc. Structure and components are also provided for reducing the noise level during printing operations.

According to one aspect of the invention, the printer includes a frame that mounts a printhead carriage mechanism. The carriage mechanism includes a reciprocally movable head carrier. A printhead adapter is removably secured to the head carrier and a printhead is secured to the adapter. The adapter is configured to accept either a conventional inkjet printhead or a conventional impact printhead. With the disclosed invention, custom designed printheads are not required. Instead, adapters configure to accept relatively standard dot matrix printheads or relatively standard inkjet printheads are used to mount the respective printheads to the head carrier. This is more cost effective as compared to designing and manufacturing custom printheads to fit directly to the head carrier.

According to a feature of this aspect, a connector forming part of a circuit board that is mounted in the printer is adapted to receive or connect to an electrical cable from the printhead. In a more preferred embodiment, the circuit board includes separate connectors for the impact printhead and the inkjet printhead.

According to another feature of this aspect of the invention, the frame includes structure that receives a removable ribbon deck when the printer is to be configured as a dot matrix printer. The ribbon deck includes interposer gearing that is operatively coupled to a carriage drive motor when the deck is installed. The interposer gearing operates to advance the ribbon in the ribbon cartridge and in particular, engages a ribbon drive element when the carriage drive motor is energized in one direction only.

According to another aspect of the invention, the printer includes a frame structure for mounting a printhead carriage that is operable to reciprocally move a printhead in order to print indicia on print media located between the printhead and a print bar. A compensator/feed assembly is movable between a printing position wherein the print bar is in a confronting relationship with the printhead and a spaced position wherein a gap or slot is defined into which a form may be inserted for subsequent printing. The compensator/paper feed assembly includes a media drive motor for selectively driving a validation printer roll or a print media pinch roll depending on the direction of rotation of the media drive motor.

According to a feature of this aspect of the invention, the printer further includes a compensator drive mechanism for moving the compensator/paper feed assembly between the printing and space positions. The compensator drive mechanism includes a compensator drive motor operatively coupled to a rotatable cam. The cam is engageable with an arm forming part of the compensator/paper feed assembly such that rotation of the cam produces pivotal movement in the assembly about a pivot. A spring urges the compensator/paper feed assembly toward the printing position and a sensor is used to detect the position of the compensator/paper feed assembly.

In a more preferred embodiment of this aspect of the invention, a sensor detects spaced apart apertures in the cam.

According to another feature of this aspect of the invention, the compensator drive mechanism also operates an inkjet cleaning station when the printer is configured as an inkjet printer. According to this feature, the cleaning station includes a reciprocally movable wiper arm that is movable between a nozzle cleaning position and a retracted position. The compensator drive motor effects movement in the wiper through a rack and pinion type engagement between gearing driven by the compensator drive motor and gear teeth defined by the arm. According to a more preferred embodiment of this feature, the gearing comprises at least one gear driven by the compensator drive motor and a driven gear releasably clutched to the drive gear. The driven gear is in a gear meshing relationship with the wiper arm.

In the illustrated embodiment, the cleaning station also includes a reservoir for collecting ink ejected by an inkjet nozzle during a cleaning cycle.

According to another feature of the invention, the compensator/paper feed assembly includes a drive roller that is driven by the media drive motor. The drive roller is engageable with a validation pressure roller when the compensator/paper feed assembly is in its printing position. The drive roller cooperates with the validation pressure roller to eject a form from the printer.

According to another feature of the invention, the compensator/paper feed assembly includes a movable diverter that moves to a diverting position at which the print media being fed along a paper path is diverted to a paper discharge opening when the compensator/paper feed assembly is in its space position. The diverter is movable to a retracted position when the compensator/paper feed assembly moves to its printing position. In the preferred and illustrated embodiment, the diverter is moved between its diverting and retracted positions by virtue of an engagement between a pin forming part of the diverter and structure defined by the compensator drive arrangement.

According to another feature of this embodiment, the validation pressure roller is held by movable cams held by the frame. The cams are used to move the pressure roller towards and away from the compensator drive roller in order to adjust a gap between the printhead and the print bar which preferably forms part of the compensator/paper feed assembly. According to a further feature of this embodiment, a stringer forming part of a carriage mechanism and which slidably engages the head carrier is also held by cams secured to the printer frame. These cams allow the stringer position to be adjusted in order to adjust the gap between the printhead and print bar.

According to another embodiment of the invention, the printer includes a frame that mounts a printhead, preferably a printhead reciprocally movable by a printhead carriage. The printhead is mounted to the carriage in a confronting relationship with a print bar assembly. A shield associated with the printhead urges print media disposed between the printhead and the print bar assembly into a budding contact with a platen forming part of the print bar assembly. The platen is preferably constructed from a zinc material and may be mounted to a platen support structure using a viscoelastic film adhesive. A plurality of isolation mounts secure the frame to an external printer case. With the disclosed construction, noise produced by the printer during its operation is substantially reduced. In the preferred and illustrated embodiment, the printhead in this embodiment comprises an impact printhead. In a more preferred embodiment, the shield associated with the printhead is a ribbon shield and also serves to reduce ribbon smudging on the print media during printing.

Additional features of the invention will become apparent and a fuller understanding obtained by reading the following detailed description made in conjunction with the accompanying drawings.

BEST MODE FOR CARRYING OUT THE INVENTION

Figure 1:
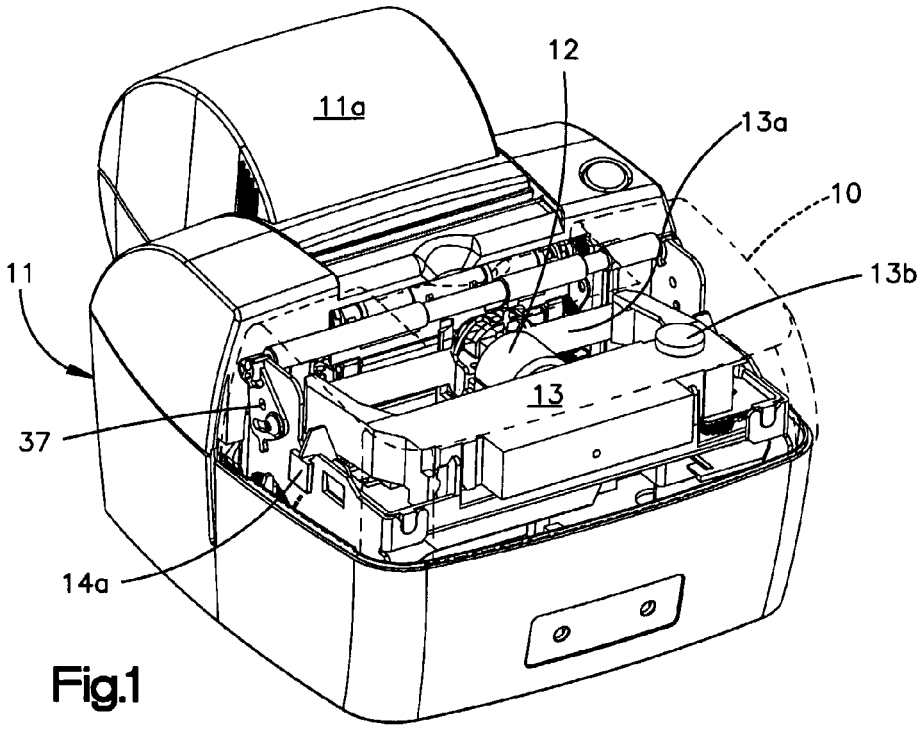
FIG. 1 is a perspective view of a transaction printer constructed in accordance with a preferred embodiment of the invention.

FIG. 1 illustrates the overall construction of a transaction printer constructed in accordance with the preferred embodiment of the invention. The printer includes a removable top front cover 10 which provides access to a printhead and printhead driving mechanism to be described. The internals of the printer are enclosed by a case 11 that includes a paper supply housing 11*a* that extends rearwardly and encloses a media compartment in which a roll of media, such as paper, is contained.

According to the invention, the disclosed printer can be configured either as a dot-matrix impact printer, or an inkjet printer. As is known, a dot-matrix impact printer employs a printhead that includes a plurality of solenoid operated needles, which are selectively energized in order to transfer ink from an inked ribbon to media, i.e., paper that is positioned in confronting relationship with the ribbon. In inkjet printing, which is also a known technology, an inkjet printhead ejects droplets of ink onto the media in controlled patterns in order to define text/graphics on the print media.

Figure 2:
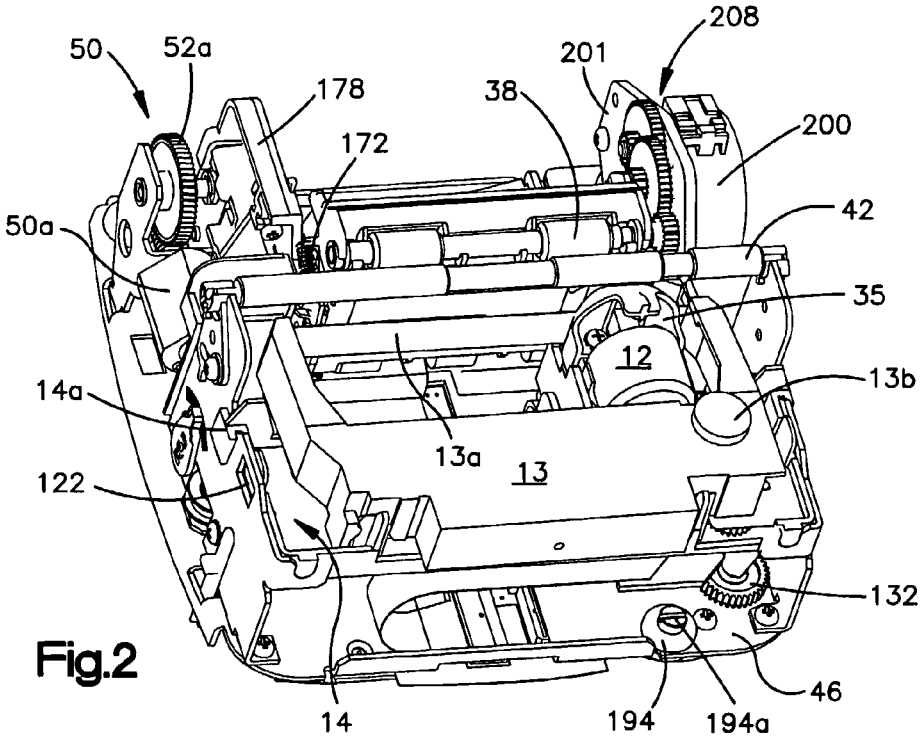
FIG. 2 is a perspective view of the printer with covers removed and with the printer configured as a dot-matrix impact printer.
Figure 5:
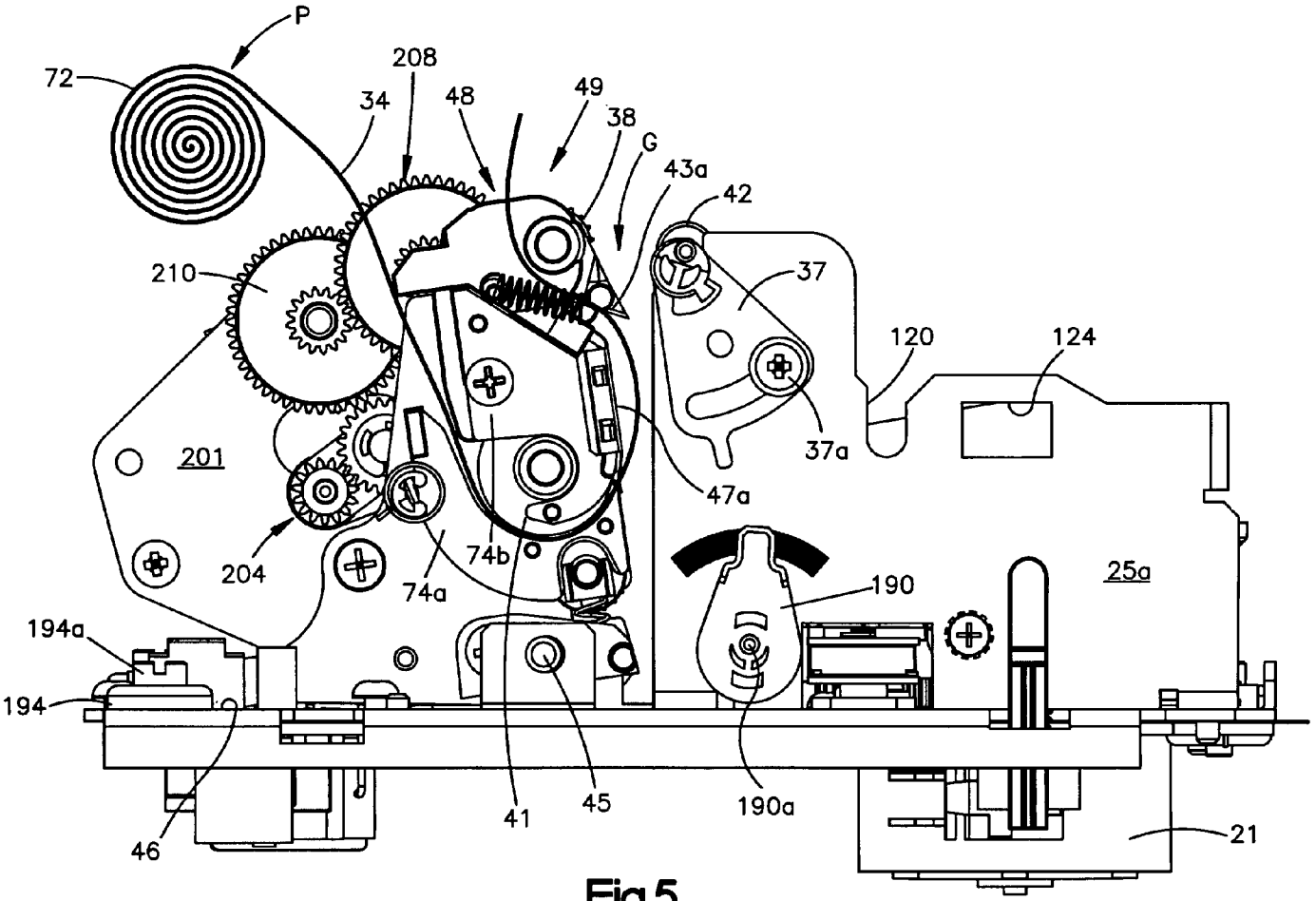
FIG. 5 is a side view of the printer with covers removed and certain portions removed to show interior detail.
Figure 7:
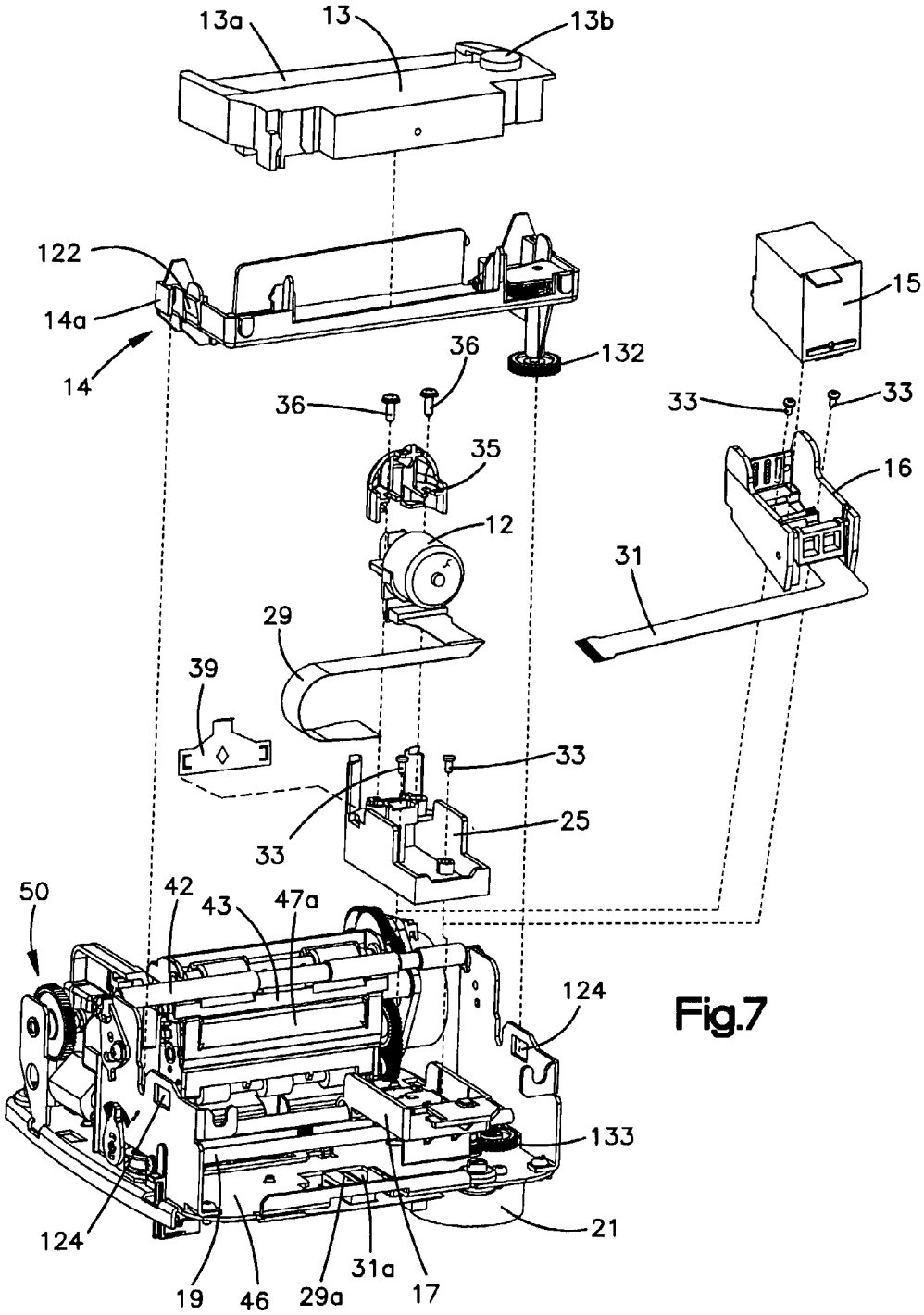
FIG. 7 is an exploded view of the printer with covers removed showing the impact printhead and inkjet printhead components that are installed into the printer depending on the desired configuration.

In FIGS. 1 and 2, the printer is configured as a dot-matrix impact printer. Referring, in particular, to FIGS. 2, 5 and 7, in this configuration, the printer includes a dot-matrix impact head 12 which is reciprocally driven side to side by a carriage (to be described). The dot-matrix head 12 is operative to transfer ink from an inked ribbon 13*a* onto a print media P (shown in FIG. 5), such as paper or a form, check, etc. inserted into a slot to be described. This is accomplished by selectively firing needles (not specifically shown) forming part of the dot-matrix head.

In the disclosed embodiment, the inked ribbon 13*a* is dispensed from a ribbon cartridge 13. Referring also to FIG. 7, the ribbon cartridge 13 is preferably snapped onto a removable ribbon cartridge deck 14. The ribbon cartridge includes a knob 13*b* that may be rotated to advance the ribbon 13*a*. As is known, the ribbon is a continuous loop and is advanced as the printhead is translated, by a mechanism to be described.

Figure 3:
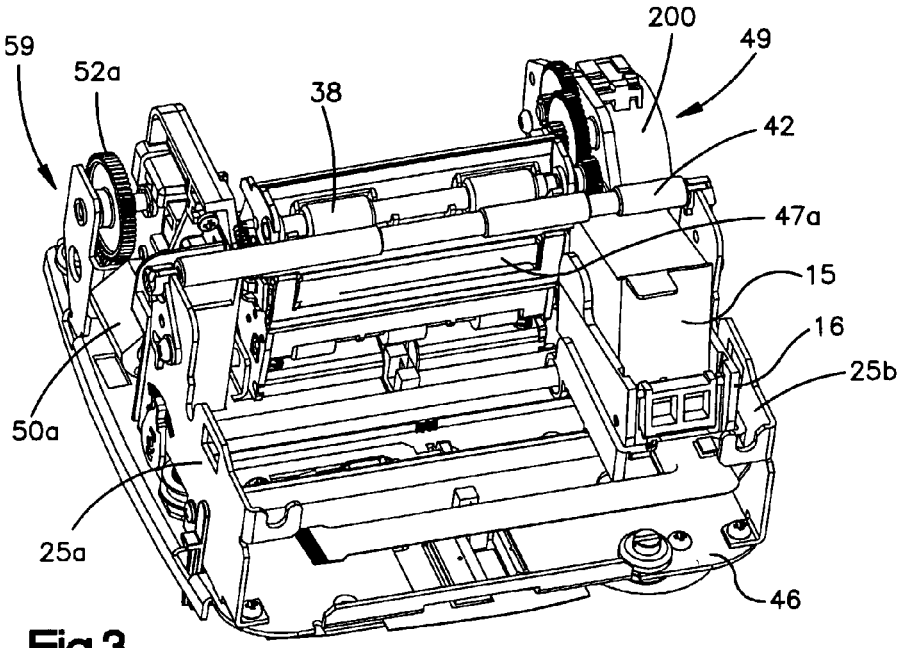
FIG. 3 is a perspective view of the printer with covers removed and with the printer configured as an inkjet printer.
Figure 4:
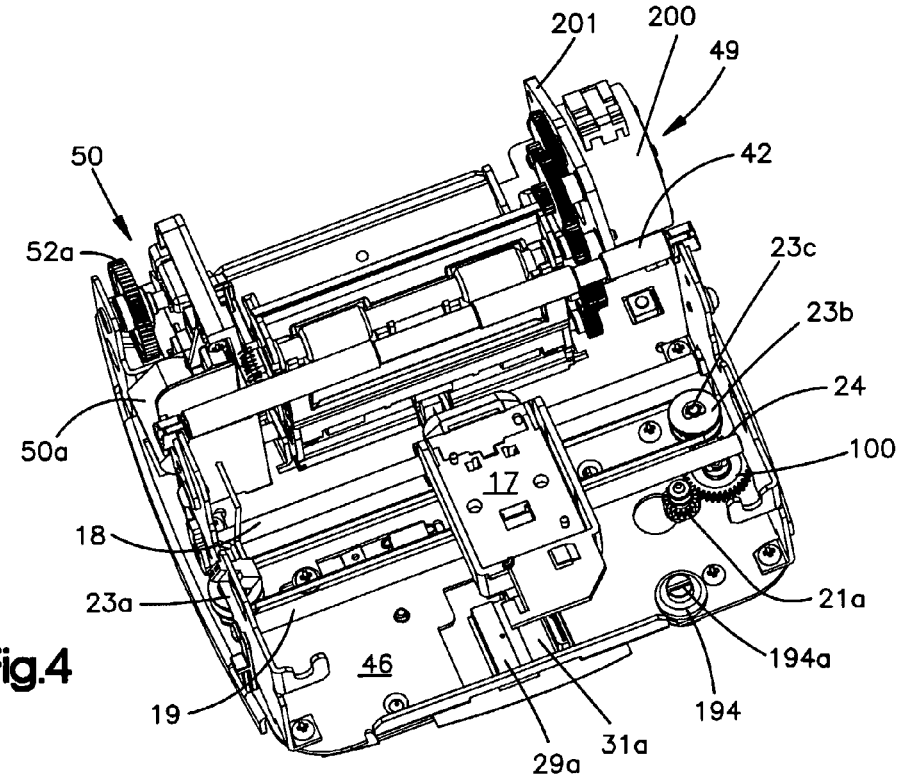
FIG. 4 is a perspective view the printer with covers removed showing a carriage mechanism to which either an impact printhead or inkjet printhead may be attached.

In FIGS. 2 and 3 the frame and internal components of the printer are illustrated, which are exposed when the printer covers are removed. In FIG. 2, the printer is configured as a dot-matrix impact printer, whereas in FIG. 3 it is configured as an inkjet printer. FIG. 4 illustrates the internals of the printer when neither the dot matrix printhead 12 nor an ink jet printhead 15 (shown in FIG. 3) are mounted. FIG. 7 shows an exploded view of the impact printhead 12 and its associated components as well as the inkjet printhead 15 and its associated components. FIG. 7 illustrates the components that must be changed when switching between an impact printing mode and an inkjet printing mode.

A printhead drive mechanism and associated components are, in general, mounted to a pair of fixed side plates 25*a*, 25*b* and a base plate 46. The side plates 25*a*, 25*b* are rigidly attached to the base plate 46. A compensator/paper feed subassembly indicated generally by the reference character 49 is pivotally mounted for movement towards and away from a validation pressure roller 42 which spans the side plates 25*a*, 25*b* and is rotatably supported by a pair of adjusting cams 37 (shown best in FIGS. 5 and 6). Referring in particular to FIG. 5, the compensator/paper feed subassembly 49 defines a paper path 34 for paper P or other print media housed within the paper compartment 11.

The compensator subassembly 49 pivots about a pivot shaft 45. As it pivots, a drive roll 38 moves towards and away from the validate pressure roller 42 that is supported by the side plates 25*a*, 25*b* via the adjustment cams 37. When the paper feed drive subassembly 49 moves rearwardly, the rolls 38, 42 separate to define a gap G (see FIG. 5) for insertion of a form or other media, such as a check, so that actuation of the printhead produces printing on the form/check, rather than the paper P.

Figure 8B:
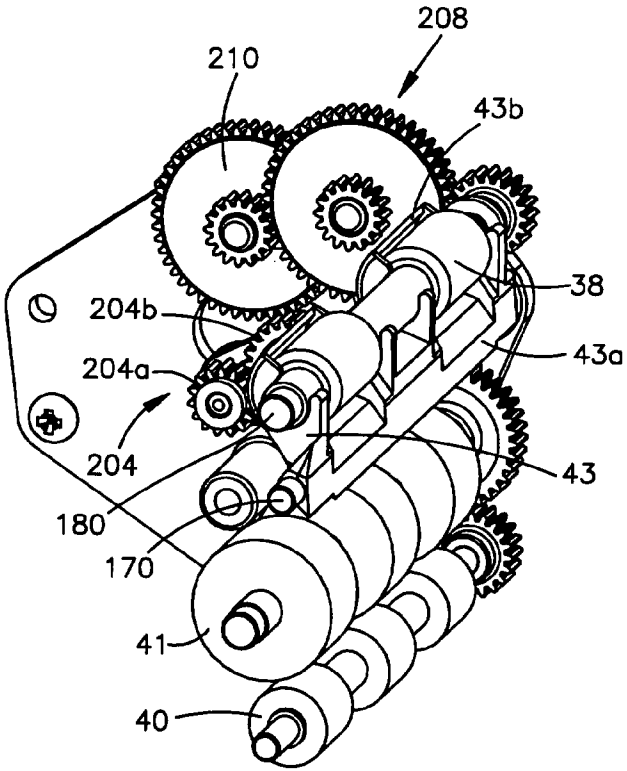
FIGS. 8A and 8B are fragmentary, perspective views of a compensator/paper feed assembly forming part of the printer.
Figure 8A:
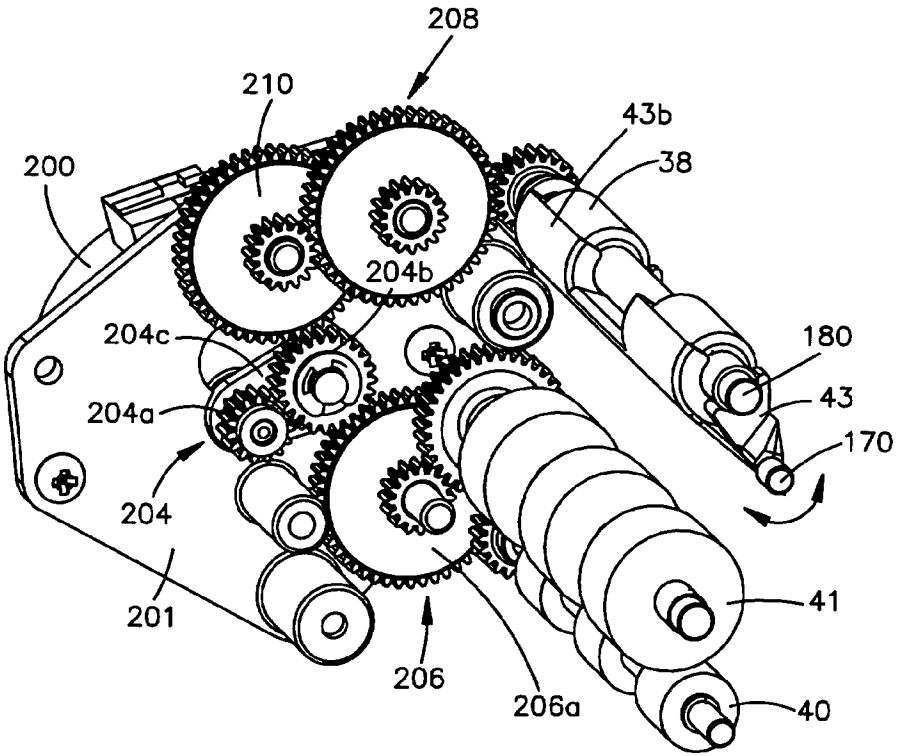
Figure 10A:
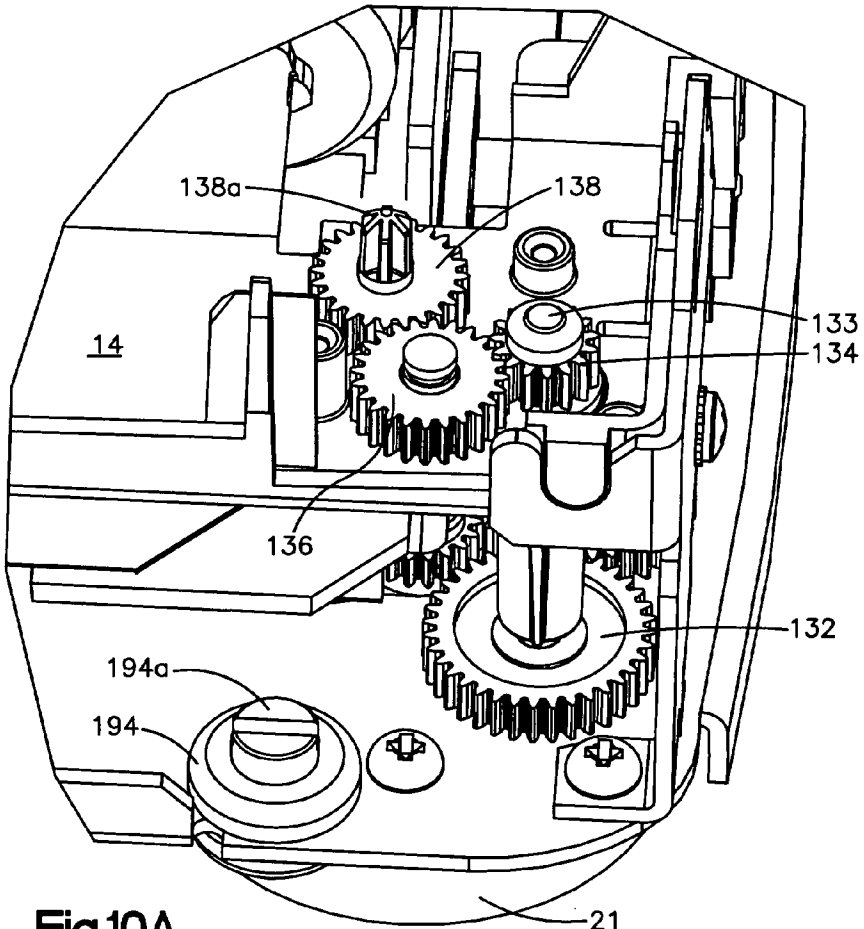
FIG. 10 is an enlarged fragmentary, perspective view of a ribbon drive mechanism.
Figure 9:
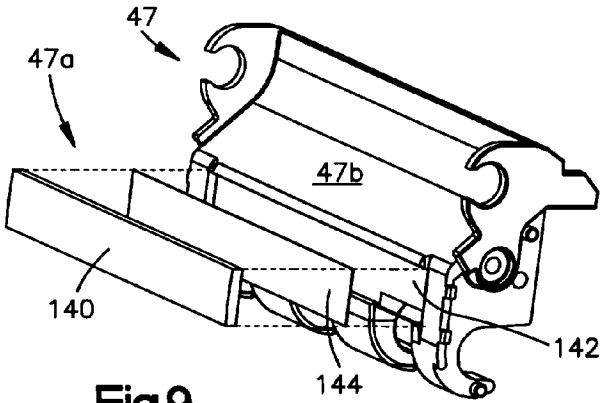
FIG. 9 is a perspective view of a printbar assembly forming part of the printer.

The paper path 34 is best shown in FIG. 5 and the print media i.e. paper P is shown schematically. As seen schematically in FIG. 5, the paper P is fed from the supply roll, indicated schematically by the reference character 72. The paper P travels downwardly between a pair of guides 74*a*, 74*b*. Referring also to FIGS. 8A, 8B and 9, the print media is then engaged by drive or pinch rollers 40, 41 from where it moves upwardly, across a print bar or platen 47*a* which forms part of a printbar/paper guide 47. After leaving the print bar 47*a*, the paper P is deflected by a paper diverter or deflector 43 (shown best in FIGS. 5 and 8A) which causes the paper P to exit the printer via an ejection slot, indicated generally by the reference character 48, and defined between the roller 38 and a curved guide 47*b* forming part of the printbar/paper guide assembly 47 (see FIG. 9).

Referring to FIGS. 8 and 9, the pinch roll 41 and the validation roll 38 are driven by a common paper feed drive motor 200 via interposer gearing indicated generally by the reference character 204 and associated gear trains 206, 208. The interposer gearing 204 includes a drive gear 204*a* attached to a drive shaft of the drive motor 200. An interposer gear 204*b* is in meshing engagement with motor drive gear 204*a* and is rotatively mounted to a swingable arm 204*c* that is frictionally coupled to the drive gear 204*a*. When the drive gear 204*a* rotates clockwise as viewed in FIG. 8A, the arm 204*c* and the associated gear 204*b* swing downwardly into an engagement with a drive gear 206*a* that forms part of the gear train 206 and rotates the pinch roll 41. When the drive gear of 204*a* is rotated counter clockwise, the arm 204*c* and the associated gear 204*b* swing upperly to engage a drive gear 210 that forms part of the gear train 208. Thus, when the drive gear is rotated counter clockwise, the validation roller 38 is rotated by the paper feed drive motor 200 via the gear train 208. With the disclosed drive arrangement, separate motors are not required to rotate the rollers 40, 41 associated with the print media P and the rollers 38, 42 associated with a form inserted in to the validation slot G. The roller 38 in cooperation with the pressure roller 41 is used to eject a form from the slot G after a printing cycle.

The paper feed drive motor 200 and gear trains 206, 208 form part of the compensator/paper feed subassembly 49 and are mounted to a sideframe 201. The sideframe pivots about the pivot shaft 45 when the compensator assembly 49 is moved towards and away from the validation roller 42.

The printhead whether it be an inkjet printhead or dot-matrix impact printhead, is translated between the printer side plates 25*a*, 25*b* in order to effect printing on the print media P or a form placed in the validation slot G (defined between the rollers 38, 42 (see FIG. 5). To achieve this movement and referring to FIGS. 4, 5 and 7, a carriage/ribbon drive motor 21 is mounted to the underside of the base plate 46 and rotates a drive gear 100. The motor 21 is reversible so that the printhead can be moved from left to right and then from right to left in a confronting relationship with the print bar 47*a*. In particular, a head carrier 17 rides on, and is attached to, transversely extending parallel stringers 18, 19. The head carrier 17 is attached to a drive belt 24 which is reeved around pulleys 23*a*, 23*b* (FIG. 4). The pulley 23*b* is driven by the drive motor 21 via gear 22 (shown in FIG. 6) that is drivingly engaged by the motor drive gear 100. The gear 22 is attached to a pulley drive shaft 23*c*.

FIG. 3 illustrates the printer configured as an inkjet printer. In this configuration and referring also to FIG. 7, an inkjet printhead 15 is mechanically attached to the head carrier 17 (see FIG. 4) by an associated adaptor 16. A cable 31 shown best in FIG. 7 electronically connects the inkjet printhead 15 to an associated cable connector 31*a* located on a circuit board mounted to the base 46.

To reconfigure the printer as a dot-matrix impact printer, the inkjet printhead 15 is detached from the inkjet adaptor 16. In the preferred embodiment, a snap connection attaches the printhead 15 to the adaptor 16. The adaptor 16 is then disengaged from the head carrier 17 preferably by removing screws 33 which secure the adaptor 16 to the carrier 17. The invention also contemplates a snap connection between the adaptor 16 and the carrier 17.

Referring to FIG. 7, a dot-matrix head adapter 25 is then secured to the head carrier 17 by the screws 33. A dot-matrix impact printhead 12 is then attached to the adapter 28 using fasteners 36 and retainer/ribbon guide 35 or alternately by virtue of a snap connection. A ribbon cable 29 extending from the printhead/adaptor is then appropriately routed to an associated cable connector 29*a* on the printed circuit board 46 mounted to the base of the printer. A ribbon shield 39 is attached to the adaptor 25 and reduces ribbon smudging on the print media and as will be explained provides a noise reducing function.

Figure 6:
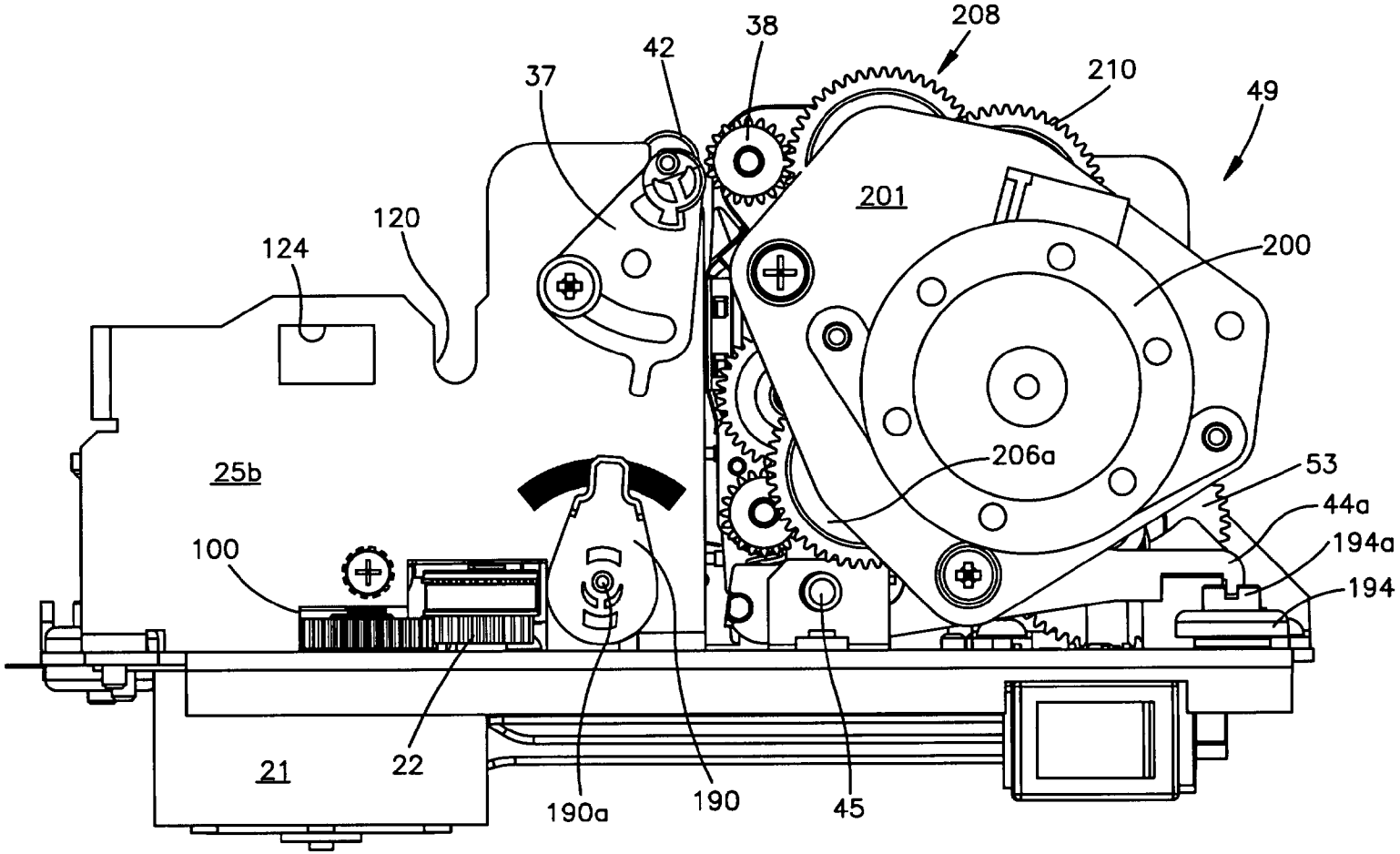
FIG. 6 is another side view of the printer with covers removed and certain portions removed to show interior detail.

Referring to FIGS. 5 and 6, the ribbon deck 14 is then snapped into position on the side plates 25*a*, 25*b*. The ribbon deck includes lugs 14*a* which are configured to be received in vertical slots 120 formed in the side plates 25*a*, 25*b* (shown in FIGS. 5 and 6). A spring loaded tongue 122 snaps into an associated aperture 124 in one or both of the side plates 25*a*, 25*b* to secure the ribbon deck 14 to the side plates.

Figure 10:
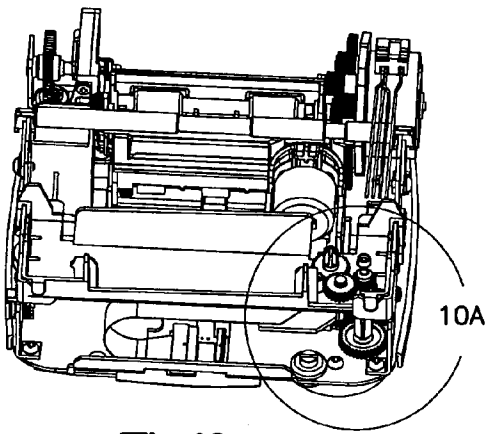

The ribbon deck 14 includes a ribbon drive mechanism that operatively couples to the carriage/ribbon drive motor 21 when the ribbon deck 14 is snapped into position. Referring in particular FIGS. 7 and 10, the ribbon deck 14 rotatably supports a drive gear 132 that meshes with a gear 100 (shown best in FIG. 4, designated as 133 in FIG. 7) that is driven directly or indirectly by the carriage/ribbon drive motor 21. Referring in particular in FIG. 10, the drive gear 132 is coupled to a gear 134 by virtue of a common shaft 133. The drive gear 134 forms part of an interposer gear assembly which includes an interposer gear 136 that moves towards and away from a ribbon drive member 138. In particular, when the drive gear 134 is rotated clockwise as viewed in FIG. 10, the interposer gear 136 (which is mounted on an arm that is frictionally coupled to the gear 134) moves towards and meshes with the ribbon drive member 138. When the drive motor 21 is reversed, the drive gear 134 rotates counter clockwise and causes the interposer gear 136 to swing counter clockwise and disengage the ribbon drive member 138. As is conventional the ribbon drive member 138 includes engagement structure 138*a* which engages a ribbon spool located in the ribbon cartridge 13 whenever the ribbon cartridge is mounted to the ribbon deck 14. With this arrangement, the ribbon drive member 138 is only rotated in one direction. The interposer gear 136 is operative to drivingly engage the ribbon drive member 138 only when the impact head is moving in one of its directions, but not both. Consequently, the interposer gearing 134, 136 causes the ribbon 13*a* to be advanced when the printhead moves from its left to its right position, but not on its return stroke or vice versa.

Figure 11:
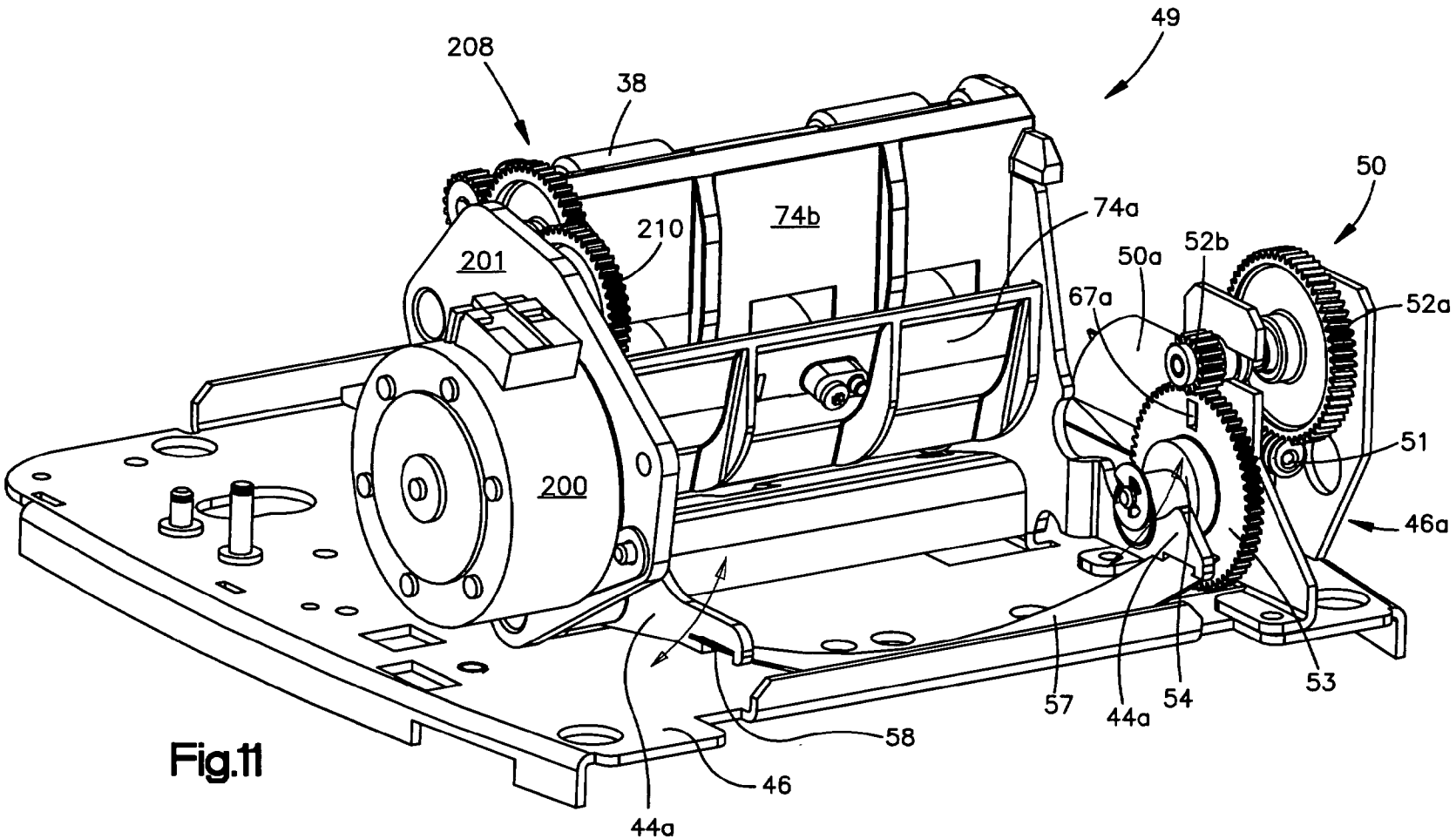
FIG. 11 is a rear perspective view of a compensator/paper feed assembly forming part of the printer.

Referring to FIG. 11 movement in the compensator/paper feed subassembly 49 towards and away from the validate pressure roll 42 is effected by a drive arrangement indicated generally by the reference character 50. The drive arrangement 50 is secured to the base 46 and includes a drive motor 50*a*, an associated worm drive gear 51 and a cam gear 53 that is driven by intermediate gearing. This intermediate gearing includes a relatively large worm gear wheel 52*a* that rotates a small drive gear 52*b* through a common shaft. The drive gear 52*b* drives the cam gear 53. The drive motor 50*a* and associated gearing is mounted to the base plate 46 by a bracket indicated generally by the reference character 46*a*.

The cam gear 53 defines a cam 54 which is engageable with one of two side plate extension arms 44*a* that form part of the compensator/paper feed subassembly 49. The arms 44*a*, as seen in FIG. 11, are biased upwardly by a leaf spring 57 having ends that are received in associated slots 58 formed in the extension arms 44*a*. The spring 57, in effect, biases the paper feed subassembly 49 towards and against the validate pressure roll 42. The spring 57 is chosen so that it supplies enough force to urge the paper feed assembly roller 38 towards contact with the validate pressure roll 42 and also counters the forces of the impact printhead needles against the print bar 47*a* during printing.

With the disclosed construction, the spring biased compensator assembly 49 "compensates" for the thickness of a form, check, etc. placed in the form slot G. In other words, the disclosed camming arrangement allows the compensator subassembly 49 to move towards the roller 42 until the roll 38 contacts a form placed in the slot G. Further rotation of the cam gear 53 (including cam 54) does not produce further movement in the compensator assembly 49. The spring 57 applies the needed force to maintain engagement of the form between the rollers 38, 42. With the disclosed arrangement, forms of greatly varying thicknesses can be accommodated and printed upon.

The cam 54 is rotated by the drive motor 50 in order to urge the end plate arms 44*a* downwardly against the spring 57 thus causing pivotal movement in the paper feed subassembly 49 about the pivot shaft 45. The cam gear 53 includes timing slots 67*a*, 67*b* which are designed and calibrated to trigger a sensor 66 at the opened and the closed form positions so that the printer control system can determine the position of the paper feed subassembly 49 (see FIGS. 11 and 12). The slots 67*a*, 67*b* are sized differently so that the printer control can distinguish them and determine what position the compensator/paper feed assembly 49 is in.

Figure 12:
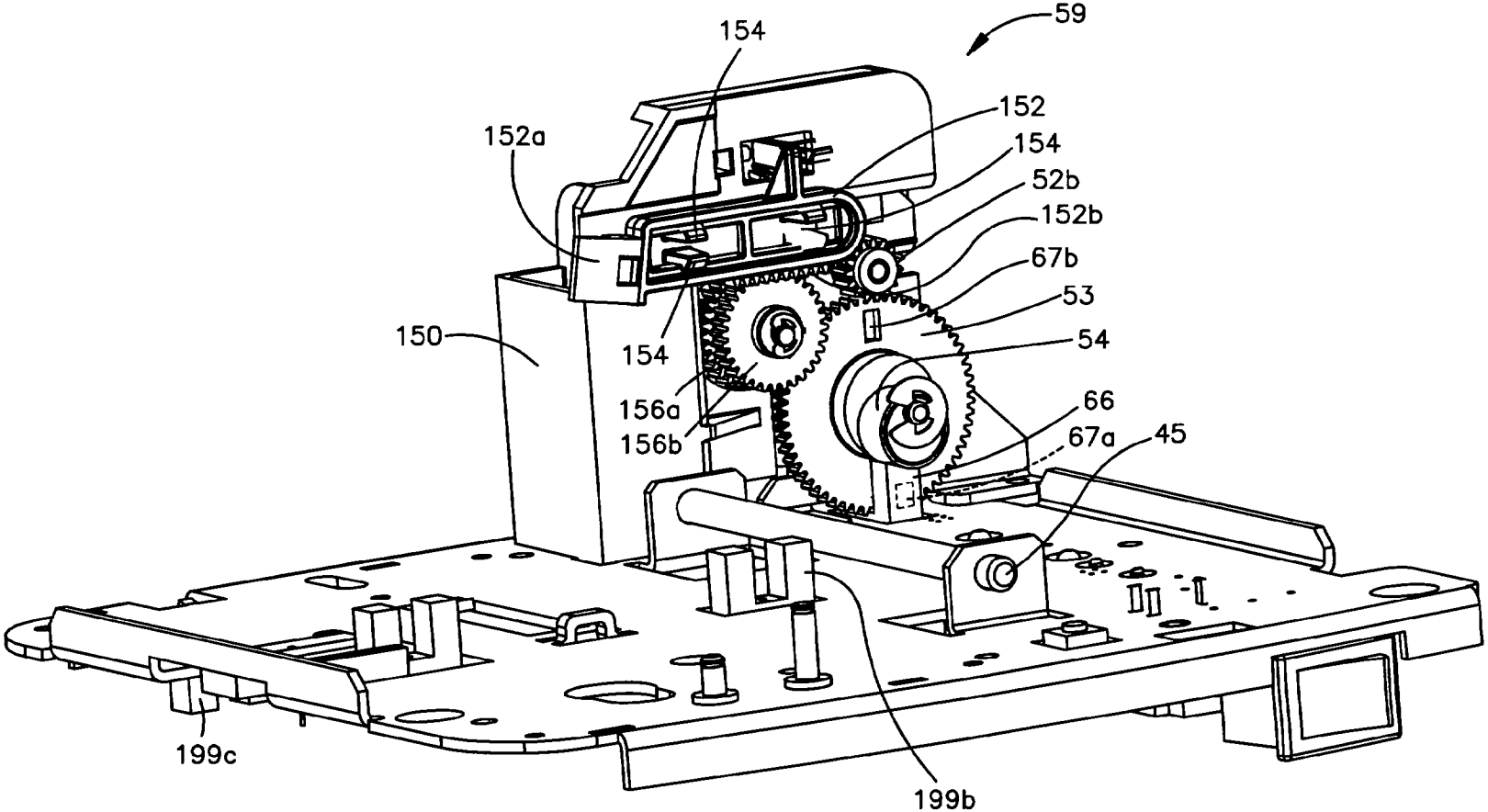
FIG. 12 is a fragmentary, perspective view of an inkjet cleaning station forming part of the printer.
Figure 13:
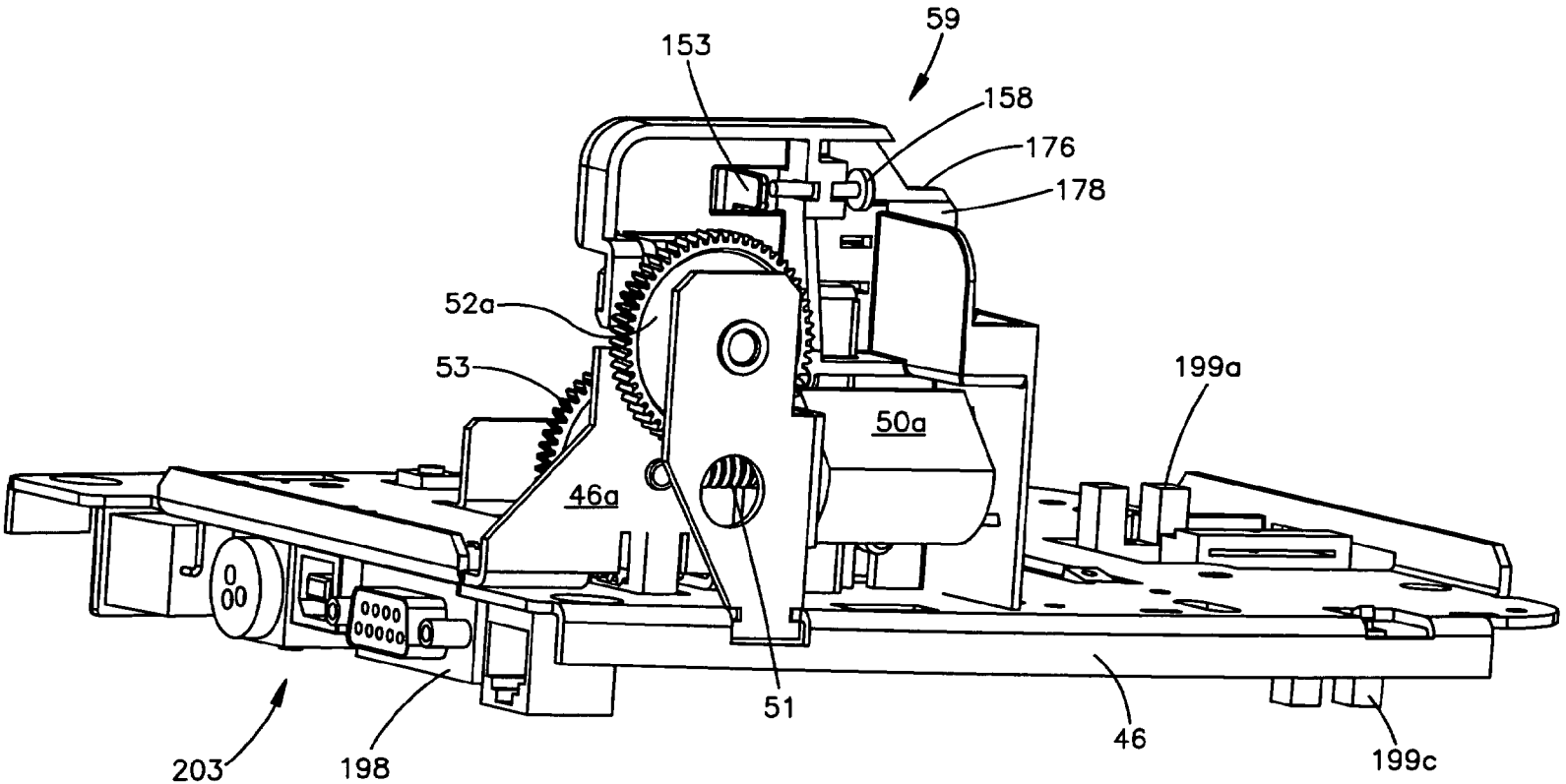
FIG. 13 is another fragmentary, perspective view of the inkjet cleaning station shown in FIG. 12; and, FIG. 14 is a fragmentary, perspective view of a diverter actuation mechanism forming part of the printer.

Referring now to FIGS. 12 and 13, when the printer is configured as an inkjet printer, a cleaning station 59 is provided which operates to clean the inkjet head nozzles at predetermined times. In accordance with the invention, the cleaning station forms part of the compensator drive arrangement 50 which as explained above moves the compensator/paper feed subassembly 49 towards and away from the compensator pressure roller 42. The bracket 46*a* which mounts the drive motor 50*a* and associated gearing (described above) is used to mount a reservoir 150 filled with cotton wadding (or other absorbent material) to catch ink droplets from the inkjet head 15 which are "spit" into the reservoir 150 during a cleaning cycle. The cleaning station 59 also mounts a reciprocally moveable wiper which wipes the inkjet nozzles during the cleaning cycle. In particular, a wiper arm 152 is mounted for sliding movement by a plurality of laterally extending tabs 154 which locate the wiper arm 152 vertically while allowing reciprocating lateral movement in the arm. The wiper arm 152 mounts a wiper element 152*a* that contacts inkjet nozzles and wipes them at the conclusion of the cleaning cycle as the inkjet head 15 passes by.

In the preferred embodiment, movement in the wiper arm 152 is effected by the drive motor 50*a* (which as explained above is also used to move the compensator assembly 49 towards and away from the validation roller 42). As seen best in FIG. 12, the cam gear 53 is gear coupled to a cluster gear that comprises a drive gear 156*a* and a driven gear 156*b*. The driven gear 156*b* engages gear teeth 152*b* defined on the lower side of the wiper arm 152. In effect, a rack and pinon drive is provided. The driven gear 156*b* is "clutched" to the drive gear 156*a*. The clutch (not shown) is configured so when wiper arm 152 reaches a predetermined position as determined by an adjustable stop 158 (FIG. 13), the driven gear 156*b* is released by the clutch so the drive gear 156*a* can rotate independently of the driven gear 156*b*. In the prefer embodiment, a spring clutch is used to couple the driven gear 156*b* to the drive gear 156*a*.

Referring also to FIG. 13, the wiper arm 152 includes an extending tab 153 which eventually contacts the stop 158 as the arm 152 is moved toward the inkjet printhead during the cleaning cycle. In the preferred and illustrated embodiment, the stop 158 is formed by an adjustable screw. During the cleaning cycle, the drive motor 50*a* is energized so that the cam gear 53 rotates clockwise as viewed in FIG. 12 which in turns causes the wiper arm 152 to move leftwardly. When the wiper arm contacts the adjustable stop screw 158, further movement is inhibited, and the driven gear 156*b* is declutched so that the drive gear 156*b* can continue to rotate relative to the driven gear. The drive motor 50*a* is then reversed rotated to cause the cam gear 53 to rotate counter clockwise in order to retract the wiper arm 152.

It should be noted here, that in the illustrated embodiment, when the printer is configured with an impact printhead 12, the printer does not include the ink jet nozzle cleaning components i.e. wiper assembly, etc. In the disclosed embodiment, the inkjet nozzle cleaning components are added only when the printer is converted to an inkjet printer. However, the invention contemplates manufacturing the printer with the complete inkjet cleaning station even when it is configured as an impact printer. By including the inkjet cleaning components in every printer regardless of its configuration, conversion to an ink jet printer is greatly facilitated. Moreover, when the printer is being converted from an ink jet printer to an impact printer, the ink jet cleaning components are generally left in the printer because they do not affect the operation of the impact print head.

Referring to FIGS. 5 and 8A, the diverter 43 is used to guide or "divert" the leading edge of the print media P into the eject slot 48. In the preferred embodiment, the diverter 43 is operative to divert the print media P into the eject opening 48 during a paper loading operation. In the preferred embodiment, the print media P is loaded into the printer when the compensator/paper feed 49 is moved towards the rear to open the slot G as seen in FIG. 5. As the compensator assembly 49 is moved rearwardly, away from the validate pressure roller 42, the leading edge 43*a* of the diverter 43 moves outwardly in order to divert the print media P into the ejection opening/slot 48 during loading of the print media. After the print media P is loaded, the compensator assembly 49 moves towards the front of the printer until the roll 38 contacts the validation pressure roll 42.

Figure 14B:
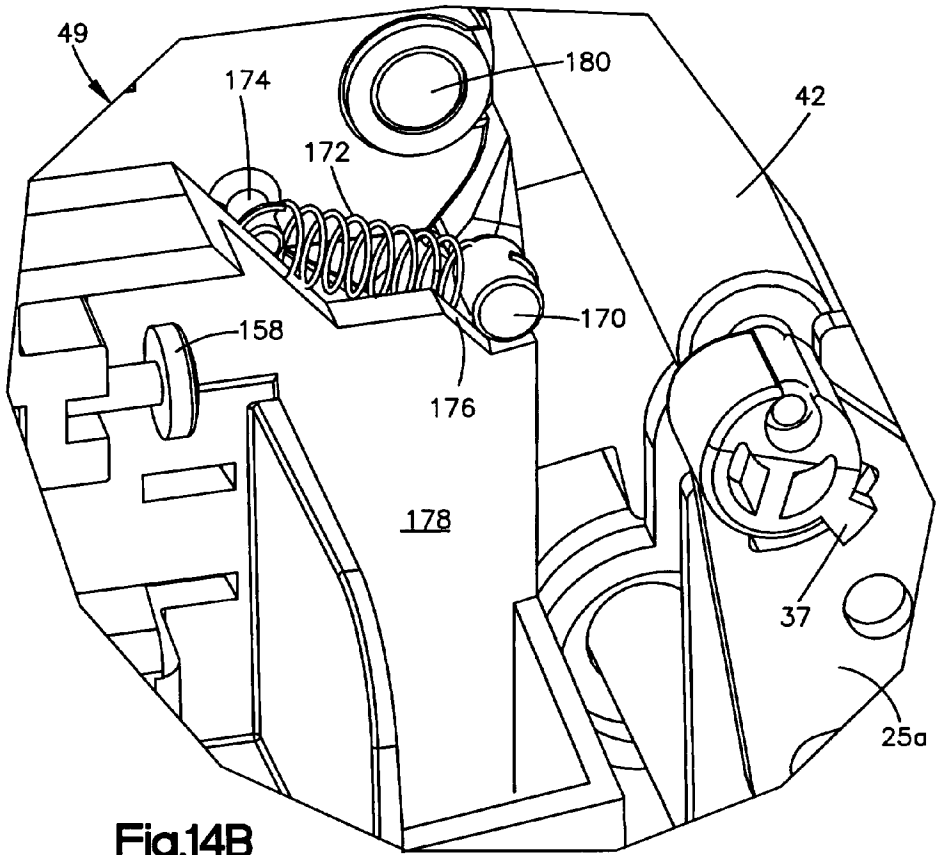
Figure 14A:
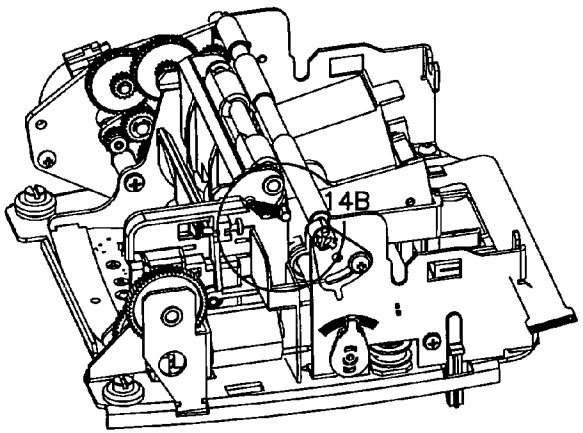

Referring to FIGS. 8A and 14, the required movement in the diverter 43 is achieved as follows: The diverter 43 includes a lateral extending pin 170. As seen best in FIG. 14, a spring 172 extends between a fixed stud 174 and the pin 170 and biases the diverter 43 towards its downwardly extending position. The pin 170 is engageable with a notch 176 formed in a fixed side plate 178 that forms part of the compensator drive arrangement 50 (see FIG. 12). As seen in FIG. 14, as the compensator assembly 49 moves leftwardly as viewed in FIG. 14, the engagement of the pin 170 with the notch 176 causes the leading edge 43*a* of the diverter 43 to swing outwardly towards the right about a pivot indicated by the reference character 180 in FIGS. 8A and 8B. When the compensator assembly 49 moves towards the right, the spring 172 that holds the pin 170 in the notch 176 causes the leading edge 43*a* of the diverter 43 to move downwardly. As seen in FIGS. 8A, 8B, the diverter 43 includes integrally formed shield 43*b* which helps guide the print media P out of the eject opening/slot 48 and prevents contact between the roller 38 and the print media P.

When the printer is switched from one type of printhead to the other, a print gap adjustment should be made. Referring to FIG. 5, this is achieved by adjustment of the cams 37 which control the position of the validation pressure roller 42. As explained above, the print bar 47*a* forms part of the compensator/paper feed subassembly 49. When printing on media P from the supply compartment 11*a*, the drive roller 38 is urged into driving contact with the validation pressure roller 42 which is fixed with respect to the side plates 25, 25*a* when the cams 37 are locked by associated locking screws 37*a*. As a consequence, the position of the validation pressure roller 42 determines the position of the drive roller 38 when the printer is in the closed position which in turn determines the location of the print bar 47*a* with respect to the side plates 25, 25*a* and, hence, the associated printhead.

Referring to FIGS. 5, 6 and 14, as the cams 37 are adjusted to move the validation pressure roller 42 towards the left, as viewed in FIG. 5, the gap between the printer bar 47*a* and the head (not shown) is increased. As the validation roll 42 is moved rightwardly by movement of the cams 37, the printer gap between the print bar or platen 47*a* and the printhead is decreased. Feeler gauges or other tools may be used to determine the exact spacing between the printhead and the printer bar 47*a* during an adjustment operation.

The gap between the print head and the print bar 47*a* is also adjusted by moving the stringer 18 (see FIG. 4) to which the print head is indirectly attached via the associated adapter and the carrier 17. As seen best in FIGS. 5 and 6, the stringer 18 is held by a pair of cams 190 which are attached to the side plates 25*a* and 25*b*. By rotating the cams 190 about their pivots 190*a*, the stringer 18 is moved laterally and changes the gap between the printhead and the print bar 47*a*. The stringer 19 loosely supports the carrier 17 and thus allows relative lateral movement between itself and the carrier 17.

According to a feature of the invention, the print bar 47*a* is acoustically dampened to reduce noise. Referring to FIG. 9, a print bar 47*a* constructed in accordance with this feature is illustrated. In particular, the print bar 47*a* includes a relatively thin impact surface which, in the preferred and illustrated embodiment, comprises a zinc plate 140 approximately 0.083" to 0.125" in thickness. The impact surface is mounted to a support structure 142 with a Viscoelastic adhesive film layer 144 approximately 0.003" to 0.005" in thickness. The adhesive film is available from Avery Dennison Corporation under the designation Avery 1185HLP. The support structure may also be made from zinc.

The viscoelastic pressure sensitive adhesive material 144 that is sandwiched between the zinc plate 140 and the main structural body 142 of the print bar 47*a* serves as the sound dampener. It is believed that the viscoelastic layer physically converts the impact vibrations to heat. Material thicknesses are selected to maximize noise dampening and may be a function of printhead size, etc. The disclosed construction provides an effective means of isolating and damping the noise and vibration created when the print needles of the impact printhead 12 strike the metal face 140.

According to further aspects of the sound reduction feature of the present invention, rubber isolation mounts 194 (see FIGS. 4-5) are used to mount the printer framing including the base 46 to the printer case 11. These mounts 194 acoustically decouple the printer hardware from the case 11. The rubber isolation mounts made be formed by grommets which engage holes in the base 46 and which receive mounting screws 194*a* in the necked section of the grommet and are threadedly engaged in the case 11.

In the preferred embodiment, the ribbon shield of 39 (shown in FIG. 7) also provides, a sound reduction function. In the preferred embodiment, the ribbon shield 39 is shaped and arranged to urge the print media P against the print bar 47*a*. It has been found that causing the print media P to remain in contact with the print bar 47*a* during the printing operation substantially reduces the sound generated by the impacting needles that form part of the impact head 12. The shield 39 reduces the amplitude of the "drum-like" sound produced by the printwires first striking the otherwise "floating" paper P, then, impacting the paper into the printbar 47*a*.

According to a further feature of this embodiment, the zinc plate 140 has a rather large curvature rather than being planar. As explained above, the compensator/paper feed subassembly 49 of which the print bar 47*a* is a component, pivots about the axis defined by the pivot shaft 45 when the printhead to print bar gap is being adjusted. The stringer 18 also in an arc when it is being adjusted by its associated cams 190. Generally, it is desirable to maintain the plane of the print bar 47*a* parallel to the plane of the printhead. Because the adjustment is made by pivoting the compensator subassembly 49 about the pivot 45 and pivoting the stringer 18, a parallel relationship between a planar print bar and the printhead cannot be maintained. As a consequence, the print bar 47*a* is formed with a rather large curvature, rather than defining it as a planar surface. As a result, the lack of parallelism that would otherwise reduce print quality is substantially reduced.

In the preferred embodiment, a circuit board 198 (see FIGS. 12 and 13) is mounted to the base 46 and includes the electronics for controlling the operation of the printer as well as communication with a host computer. The circuit board 198 preferably mount sensors i.e. 199*a*, 199*b*, 199*c* (see FIGS. 12 and 13), for monitoring one or more positions of the head carrier 17, the presence of a form within the forms slot G, the position of the compensator/paper feed assembly 49 as well as the positions of printer covers, etc. In the preferred embodiment, the circuit board mounts the connectors 29*a*, 31*a* to which the impact print head 12 and inkjet printhead 15 are electronically connected, respectively as well as other external connectors or ports indicated generally by the reference character 203 in FIG. 13. The invention also contemplates on board software or firmware for not only detecting the type of printhead mounted in the printer, but for also controlling the operation and movement of the printhead during printer use.

Although the invention has been described with a certain degree of particularity, it should be understood that those skilled in the art can make various changes to it without departing from the spirit or scope of the invention as hereinafter claimed.

The invention claimed is:

1. A transaction printer, comprising:

a) a frame mounting a reciprocally movable print head carriage;

b) a printhead mounted to said carriage and in a confronting relationship with a print bar assembly, said printhead comprising an impact printhead;

c) a shield associated with said printhead for urging print media disposed between said printhead and said print bar assembly into abutting contact with a platen forming part of said print bar assembly;

d) said platen including a zinc plate entirely constructed from a zinc material and being supported in a confronting relationship with said printhead, said zinc plate being non-planar and having a predetermined curvature; and, e) a plurality of isolation mounts securing said frame to an external printer case whereby said frame is acoustically isolated from said case.

2. The printer of claim 1 wherein said shield is a ribbon shield and is disposed between said print media and an inked ribbon disposed between said shield and said printhead.

3. The printer of claim 1 further comprising a feeder assembly for feeding print media from a print media supply along a print media path that passes between said print bar assembly and said printhead.

4. The printer of claim 3 wherein said feeder assembly mounts said print bar assembly and is pivotally movable between a printing position and another position at which it is spaced from said printhead such that when it moves to its spaced position a form receiving slot is defined into which a form can be inserted to be printed upon by said printhead when said feeder assembly moves to its printing position.

5. The printer of claim 1 wherein said platen plate is mounted to a platen support structure using a viscoelastic film adhesive.

6. A transaction printer, comprising:

a) a frame structure mounting a printhead carriage for reciprocally moving a printhead in order to print indicia on print media located between said printhead and a print bar;

b) a compensator/paper feed assembly, said assembly movable between a printing position wherein said print bar is in a confronting relationship with said printhead and a spaced position wherein a gap is defined into which a form may be inserted for subsequent printing;

c) said compensator/paper feed assembly including a media drive motor for selectively driving a validation pressure roll or a print media pinch roll, depending on the direction of rotation of said motor.

7. The printer of claim 6 further comprising a compensator drive mechanism for moving said compensator/paper feed assembly between said printing and said spaced position, said compensator drive mechanism comprising:

a) a compensator drive motor operatively coupled to a rotatable cam;

b) said cam operatively engageable with an arm forming part of said compensator/paper feed assembly such that said rotational cam produces pivotal movement in said assembly about a pivot;

c) a spring urging said compensator/paper feed assembly towards said printing position;

d) a sensor for detecting the position of said compensator/paper feed assembly.

8. The apparatus of claim 7 wherein said sensor detects spaced apart apertures in said cam.

9. The printer of claim 7 wherein said compensator drive mechanism operates an inkjet cleaning station when said printer is configured as an inkjet printer.

10. The printer of claim 9 wherein said cleaning station includes a reciprocally movable wiper arm movable between a nozzle cleaning position and a retracted position, said compensator drive motor effecting movement in said wiper arm through a rack and pinion type engagement between gearing driven by said compensator drive motor and gear teeth defined by said arm.

11. The printer of claim 10 wherein said gearing comprises at least one gear driven by said compensator drive motor and a driven gear releasably clutched to said drive gear, said driven gear in a gear meshing relationship with said wiper arm.

12. The printer of claim 9 wherein said cleaning station further comprises a reservoir for ink ejected by inkjet nozzles during a cleaning cycle.

13. The printer of claim 7 wherein said compensator/paper feed assembly includes a drive roller driven by said media feed motor that is engageable with a validation pressure roller when said compensator/paper feed assembly is in its printing position, said drive roller operative to eject a form from said form receiving gap.

14. The printer of claim 13 wherein said compensator/paper feed assembly includes a movable diverter, said diverter moving to a diverting position which diverts print media being fed along said paper path to an eject opening when said compensator/paper feed assembly is in its spaced position and said diverter movable to a retracted position when said compensator/paper feed assembly moves to its printing position.

15. The printer of claim 14 wherein said diverter is moved between its diverting and retracted positions by virtue of an engagement between a pin forming part of said diverter and structure defined by said compensator drive arrangement.

16. A transaction printer, comprising:

a) a printhead for printing indicia on print media located between said printhead and a print bar;

b) a compensator/print media feed assembly including structure for supporting said print bar, said assembly movable between a printing position wherein said print bar is in a confronting relationship with said printhead and a spaced position wherein an opening is defined into which a form may be inserted, said form being positioned between said print bar and said printhead;

c) said compensator/print media feed assembly including a feeder drive motor for selectively driving a validation drive roll or a print media pinch roll, depending on the direction of rotation of said feed motor.

17. The transaction printer of claim 16 wherein said printhead is mounted for reciprocating movement with respect to said print bar by a printhead carriage.

18. The transaction printer of claim 16, wherein said compensator/print media feed assembly includes a media diverter that is operative to divert a leading edge of print media to an ejection opening when said compensator/print media feed assembly is in its spaced position.

19. The printer of claim 16 further comprising a compensator drive mechanism for moving the compensator/media feed assembly between said printing and spaced positions.

20. The printer of claim 18 wherein said diverter is moved between an extended position and a retracted position by a camming arrangement defined between a cam forming part of said diverter and a cam surface defined by said compensator drive mechanism.

21. The printer of claim 16 further including a printhead carriage mechanism for reciprocally moving said printhead with respect to said print bar.

22. The printer of claim 21 wherein said carriage mechanism includes at least one adjustably movable stringer which is used to adjust the spacing between said print bar and said printhead.

23. The printer of claim 22 wherein said printer includes a validation pressure roll that is mounted for movement towards and away from said validation drive roll such that the position of said validation pressure roll can be adjusted to adjust the spacing between said print bar and said printhead.

24. The printer of claim 23 wherein said stringer and validation pressure roll are adjustably mounted to a side frame forming part of said printer by associated cams.

25. A transaction printer, comprising:

a) a frame mounting a reciprocally movable print head carriage;

b) a printhead mounted to said carnage and in a confronting, relationship with a print bar assembly;

c) a shield associated with said printhead for urging print media disposed between said printhead and said print bar assembly into abutting contact with a platen forming part of said print bar assembly, said shield being a ribbon shield and disposed between said print media and an ink ribbon disposed between said shield and said print head;

d) said platen constructed from a zinc material and being supported in a confronting relationship with said printhead;

e) a plurality of isolation mounts securing said frame to an external printer case whereby said frame is acoustically isolated from said case; and, f) a feeder assembly for feeding print media from a print media supply along a print media path that passes between said print bar assembly and said print head.

26. A transaction printer, comprising:

a) a frame mounting a reciprocally movable print head carriage;

b) a printhead mounted to said carriage and in a confronting relationship with a print bar assembly;

c) a shield associated with said printhead for urging print media disposed between said printhead and said print bar assembly into abutting contact with a platen forming part of said print bar assembly;

d) said platen constructed from a zinc material and being supported in a confronting relationship with said printhead;

e) a plurality of isolation mounts securing said frame to an external printer case whereby said frame is acoustically isolated from said case; and f) a feeder assembly for feeding print media from a print media supply along a print media path that passes between said print bar assembly and said printhead, said feeder assembly mounting said print bar assembly and being pivotally movable between a printing position and another position at which it is spaced from said printhead such that when it moves to its spaced position a form receiving slot is defined into which a form can be inserted to be printed upon by said printhead when said feeder assembly moves to its printing position.

* * * * *